US006910520B2

(12) United States Patent
Aoki

(10) Patent No.: US 6,910,520 B2
(45) Date of Patent: Jun. 28, 2005

(54) MOLD FOR CASTING

(75) Inventor: Tatsuya Aoki, Yaizu (JP)

(73) Assignee: Asahi Tec Corporation (JP)

( * ) Notice: Subject to any disclaimer, the term of this patent is extended or adjusted under 35 U.S.C. 154(b) by 151 days.

(21) Appl. No.: 10/626,870

(22) Filed: Jul. 25, 2003

(65) Prior Publication Data

US 2004/0134636 A1 Jul. 15, 2004

(30) Foreign Application Priority Data

Jul. 29, 2002 (JP) ..... 2002-219801

(51) Int. Cl.[7] ..... B22D 18/04
(52) U.S. Cl. ..... 164/306; 164/119; 164/254
(58) Field of Search ..... 164/63, 119, 254, 164/306

(56) References Cited

FOREIGN PATENT DOCUMENTS

| | | |
|---|---|---|
| JP | 5-269563 | 10/1993 |
| JP | 2000-263188 | 9/2000 |
| JP | 2001-71115 | 3/2001 |
| JP | 2002-346694 | * 12/2002 |

* cited by examiner

*Primary Examiner*—Kuang Y. Lin
(74) *Attorney, Agent, or Firm*—Parkhurst & Wendel, L.L.P.

(57) ABSTRACT

There is disclosed a mold (1) for casting including: a lower mold (6) having four gates (5) (at least one gate); an upper mold (7) being matched with the lower mold (6) to form a cavity; and side molds (2*a*), (2*b*) being matched with the lower mold (6) and upper mold (7) to form the cavity and being split (into at least two). In the mold (1) for casting is constituted an upper surface of a weir (4) of a flat portion of side molds (2*a*), (2*b*), and other surfaces of the weir (4) is constituted of a concave portion of the lower molds (6), and the weir (4) is disposed so as to keep a parting line (3) between the side molds (2*a*), (2*b*) away. The mold (1) for casting can easily be demolded, and the desired number of gate systems can be formed in desired positions.

3 Claims, 5 Drawing Sheets

MOLD FOR CASTING

FIELD OF THE INVENTION

1. Field of the Invention

The present invention relates to a mold for casting through which cast products are molded. More particularly, it relates to a mold for casting which can easily be opened and in which a desired number of gates can be formed in desired positions.

2. Description of the Related Art

Casting is a molding method for charging molten metal into a cast (mold, sand cast or the like) which has a cavity (molding space) having a product shape and cooling/solidifying the molten metal to obtain a product. Since it is possible to manufacture a product having a complicated shape in one step, the method is used, for example, in manufacturing components for a vehicle such as a cylinder block, cross member, and wheel.

Moreover, in recent years, the casting has been carried out using a mold for casting (hereinafter referred to simply as a mold) in which a plurality of gates is disposed (JP-A-5-269563). This mold for casting has characteristics in that the flow distance is short and that temperature drop is little since a molten metal is injected into a mold via a plurality of gates. The mold has advantages that the molten metal flows well in the mold, has little manufacturing defects, and can also be applicable to thin-wall products.

On the other hand, the mold for casting including a plurality of gates has disadvantages that there are many portions exposed to outside air and that the oxidation in those portions occurs easily. Therefore, a structure is used in many cases in which the gates are opened in an outer periphery of a cavity and the cavity is connected to the gate via a weir. In this structure, a metal gauze is used in the gate, accordingly an oxide film is held in a gate portion that is cut/removed in a subsequent process, and therefore the oxide film hardly remains in a product surface as in a structure in which the gate is directly opened in the cavity.

Moreover, the mold for casting including a divided structure constituted of a plurality of molds is used in the casting, and the casting is carried out in a combined state of the individual molds in many cases. In this structure, after end of the casting, these molds can be separated and opened, and products are easily demolded.

For example, when the mold is used to cast/mold the wheel for the vehicle, the mold has heretofore been divided into a lower mold having the gate(s), and upper and side molds which are to be matched with the lower mold. In consideration of ease of processing, a weir(s) which is (are) a channel for a molten metal to connect the cavity and the gate is usually formed in a parting line between the lower and side molds (hereinafter referred to also as PL).

Moreover, a structure of the weir has heretofore been used in which both the lower and side molds are carved to form a concave portion for connecting the gate(s) and the cavity in each of the molds. This is because the mold can easily be slid not to interfere with the product.

For example, one example of the mold for use in preparing a wheel 41 shown in FIG. 4 (perspective view) and FIG. 5 (sectional view). The wheel 41 includes a thin-wall rim (outer rim 43 and inner rim 42) and a thick-wall spoke 44. A mold for casting 111, shown in FIG. 3, for molding the wheel includes: a lower mold 103 including a gate 118; side molds 102 matched with the lower mold 103 and divided into two (by the parting line of the vertical direction (not shown)); and an upper mold 101 matched with the lower mold 103 and side molds 102. When the side molds 102 are slid toward the outside of the mold, the mold can be opened.

Moreover, in the mold for casting 111, the PL between the split side molds 102 needs to be disposed in accordance with a gate system 107 including passageways 117, gates 118, and weirs 119. This prevents a pushed molten metal portion being formed by the molten metal to protrude into the weir 119 from the cavity at the time of coagulation from inhibiting the sliding of the side mold 102 and the mating side mold 102.

To prevent the molten metal coagulated in the weir 119 from inhibiting the movement of the side molds 102, for example, a structure is also considered in which the number of divided side molds 102 is increased or the gate system 107 is oriented in a moving direction of the side molds 102, but this disadvantageously complicates the metal structure.

From this situation, in the mold for casting according to the conventional structure, a position where the gate system is to be formed or the number of gate systems has been limited. It is originally preferable to form the desired number of gate systems in desired positions in accordance with a product shape in consideration of a molten metal flow, but this cannot be realized. Therefore, the mold according to the conventional structure has had a problem in that a degree of freedom in designing the mold is lowered and the structure is limited.

The present invention has been developed in consideration of the problem of the prior art, and an object thereof is to provide a mold for casting which can easily be opened and in which a desired number of gate systems can be formed in desired positions.

SUMMARY OF THE INVENTION

As a result of an intensive study, it has been found that, in a mold for casting having a split structure, the above-mentioned objective can be achieved by forming a weir(s) with a concave portion formed in a lower mold and a flat portion having no concave/convex portions in side molds, and thus the present invention has been completed based on this finding.

That is, according to the present invention, there is provided a mold for casting comprising: a lower mold including at least one gate; an upper mold which is matched with the lower mold to form a cavity; and a side mold which is matched with the lower and upper molds to form the cavity and which is split into at least two side mold halves, characterized in that a weir for connecting the cavity and the gate is formed by an upper surface constituted of a flat portion of the side mold, and other surfaces constituted of a concave portion of the lower mold, and is disposed so as to keep a parting line between at least two split side mold halves away from the weir.

In the present invention, the flat portion of the side mold is preferably inclined slightly downwards to the outside of the mold from a center of the cavity. Moreover, the flat portion of the side mold is preferably continuously formed so as to surround an outer periphery of the cavity. Furthermore, the flat portion of the side mold is preferably formed by a divided insert.

DESCRIPTION OF THE PREFERRED EMBODIMENT

A mold for casting according to the present invention will be described hereinafter in detail. It is to be noted that in the present specification, a combination of a weir, gate, and passageway will be referred to as a gate system. A molten metal channel indicates the weir and passageway. A concave portion disposed in a lower mold expresses that the lower mold alone is depressed when seen from the outside, and the concave portion passes through the lower mold as a hole to form the molten metal channel.

(1) Characteristics of Mold for casting of the Invention

A mold for casting of the present invention includes: a lower mold including at least one gate; an upper mold which is matched with the lower mold to form a cavity; and a side mold which is matched with the lower and upper molds to form the cavity and which is divided in at least two molds. The characteristics of the mold for casting of the present invention lie in that a weir for connecting the cavity and the gate is composed of an upper surface defined by a flat portion of the side mold, and surfaces other than the upper surface defined by a concave portion disposed in the lower mold, and the weir (i.e., a gate system including the weir) is disposed so as to keep a parting line between at least two divided side molds away.

In other words, the mold for casting of the present invention includes a structure in which an upper part of the concave portion of the lower mold is closed by the surface of the side mold wherein no concave/convex portion is formed, to form the weir, and the weir is carved only in the lower mold, taking the PL between the lower and side molds as a standard line. In this manner, the pushed molten metal portion formed from the overflowed and coagulated molten metal from the cavity does not penetrate into the side molds, and the side molds are not inhibited from sliding. Therefore, it is easy to open the mold.

Moreover, since the molten metal having overflowed from the cavity to coagulate does not penetrate into the side molds, the gate system does not have to be necessarily formed along with the PL between the side molds. That is, formation positions and number of gates are not limited, and it is possible to form the desired number of gates in desired positions in accordance with a product shape. The mold for casting of the present invention has a high degree of freedom in mold design, and the structure is not restrictive.

Furthermore, by a simple structure in which the lower and side molds form the weir, since the weir is formed from the concave portion formed only in the lower mold, and the flat portion of the side mold having no concave/convex portion, the above-described effect can be attained. Therefore, a complicated structure of the mold for casting, in which the number of split side molds should be increased, is not required.

(2) Constitution of Mold for casting of the Present Invention

Figure 1A:
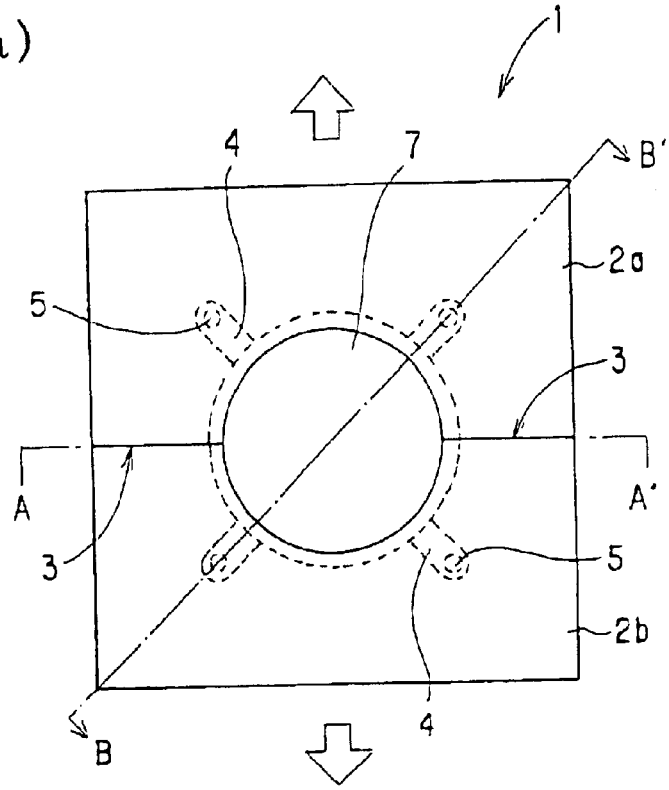
FIGS. 1(*a*) and (*b*) are explanatory views showing one embodiment of a mold for casting according to the present invention, FIG. 1(*a*) is a schematic top plan view, FIG. 1(*b*) is a schematic A–A' sectional view in FIG. 1(*a*), and FIG. 1(*c*) is a schematic B–B' sectional view in FIG. 1(*a*)
Figure 1B:
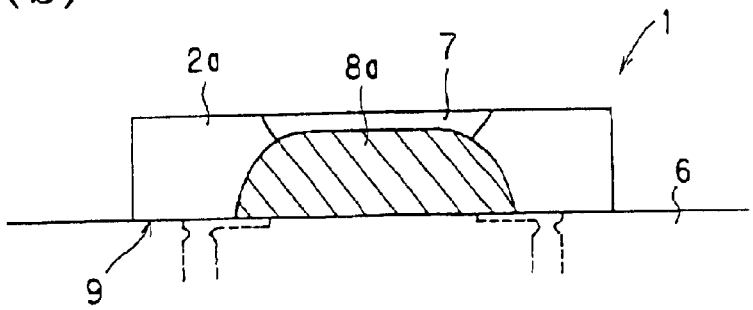
Figure 1C:
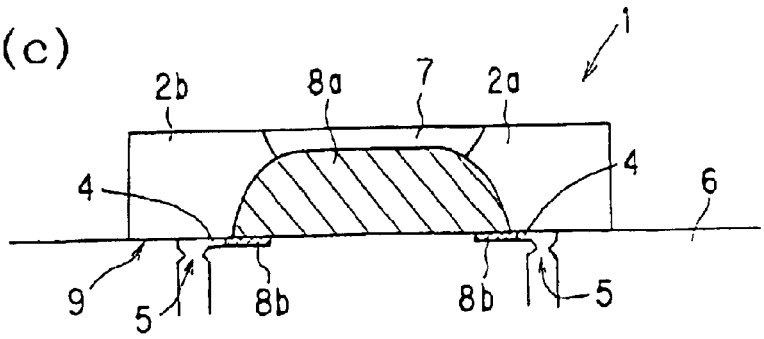

A constitution of the mold for casting according to the present invention will be described with reference to FIGS. 1(*a*) to 1(*c*). It is to be noted that according to the present invention, as described above, there is provided a mold for casting including: a lower mold having at least one gate; an upper mold which is matched with the lower mold to form the cavity; and a side mold which is matched with the lower and upper molds to form the cavity and which is split into at least two molds. The present invention is not limited to a mold for use in obtaining a wheel as a cast member, and is not limited to the following embodiment.

The mold for casting includes a cavity which is constituted of SKD61 or ductile cast iron and which has a shape corresponding to a product. For example, the mold for casting 1 shown in FIGS. 1(*a*) to 1(*c*) includes a dome-shaped cavity.

The mold for casting 1 is a mold including a split structure, and includes at least three types of molds: a lower mold 6 having four gates 5 opened in an outer periphery of a cavity (space for molding a molded body 8*a*); two split side molds 2*a*, 2*b* which are matched with the lower mold 6; and an upper mold 7 which are matched with the lower mold 6 and side molds 2*a*, 2*b*. Additionally, in the present invention, for the upper, lower, and split side molds, the number of divisions of molds is not limited, and two or more sub-molds may exist as each type of mold. Moreover, these molds may also include an insert as a component.

1) Lower Mold

The lower mold described in the present invention is of a split type which is fixed to a stoke (pipe-shaped member for supplying molten metal to the mold for casting) in a connected state and which includes a gate system for injecting the molten metal supplied from the stoke into the mold for casting.

The lower mold enhances molten metal flow in the mold for casting, reduces casting defects, can be used for thin-wall products, and therefore includes a plurality of gates. The lower mold 6 shown in FIG. 1(*a*) includes four gates 5 disposed at a 90° interval with respect to a center of the cavity.

Moreover, for the lower mold, in order to prevent an oxide film from remaining in a product surface, the plurality of gates are not directly opened into the cavity, and are opened in the outer periphery of the cavity. In the lower mold 6 shown in FIG. 1(*a*), four gates 5 are opened in the outer periphery from a circle constituting a dome-shaped bottom surface of the cavity.

In the lower mold, the concave portion for connecting the gate and the cavity is formed. The concave portion constitutes the weir for connecting the gate and the cavity. The upper part is opened in an opened mold state. However, when the mold is closed, the upper part of the concave portion is closed by the flat portion of the side molds having no concave/convex portion to form the weir. The shape of the concave portion disposed in the lower mold is not especially limited, but is usually formed in a groove shape.

2) Side Mold

The side mold described in the present invention is matched with the lower and upper molds, split into at least two, and can be slid to open/close the mold. It is to be noted that "mold matching" means the state that two or more molds abut on one another via the PL face.

For the side mold, a portion corresponding to the PL face between the side and lower molds needs to be constituted as the flat portion having no concave/convex portion. The flat portion serves as a lid member to close the upper part of the lower mold, and constitutes a part of the weir for connecting the gate and the cavity. In this structure, since the weir is not carved in the side mold on the basis of the PL face between the lower and side molds, it is possible to prevent the molten metal having overflowed from the cavity to coagulate (pushed molten metal portions 8*b*) from penetrating into the side molds.

To obtain the above-described effect, it is sufficient to constitute at least a portion corresponding to the upper part of the concave portion of the lower mold by the flat portion of the side mold having no concave/convex portion, but the flat portion of the side mold is preferably continuously formed to surround the outer periphery of the cavity. In this manner, the mold for casting does not have to be formed in a complicated structure, for example, in which the number of split side molds is increased, and the effect of the present invention can be attained by a simple structure.

Moreover, the flat portion of the side mold is preferably inclined slightly downwards to the outside of the mold from the center of the cavity. Moreover, the flat portion of the side mold is preferably continuously formed so as to surround the outer periphery of the cavity. This is because the mold can more smoothly be opened/closed.

Furthermore, the flat portion of the side mold is preferably formed by a split insert. The weir including the flat portion of the side mold as a constituting element usually has a small sectional area. However, the insert portion is disposed to delay heat conduction so that heat is not easily released. Accordingly, the weir can be solidified in the last place, and therefore molten metal replenishing property at the time of coagulation/contraction.

With respect to conditions other than the above-described constitution, the mold for casting of the present invention is not especially limited, and a desired structure can be employed. For example, if necessary, molten metal pushing or gas purging may be constituted in order to secure soundness of the product.

The mold for casting of the present invention can be used in an incorporated form in various types of conventional known casting apparatuses. The type of the casting apparatus is not especially limited, but can be used in the incorporated form in a low-pressure casting apparatus.

EXAMPLES

Next, the embodiment of the present invention will be described in more detail using an example of a mold for casting for casting the wheel 41 shown in FIGS. 4 and 5 also with reference to FIG. 2. Needless to say, the present invention is not limited to an embodiment shown in the figures.

Figure 2:
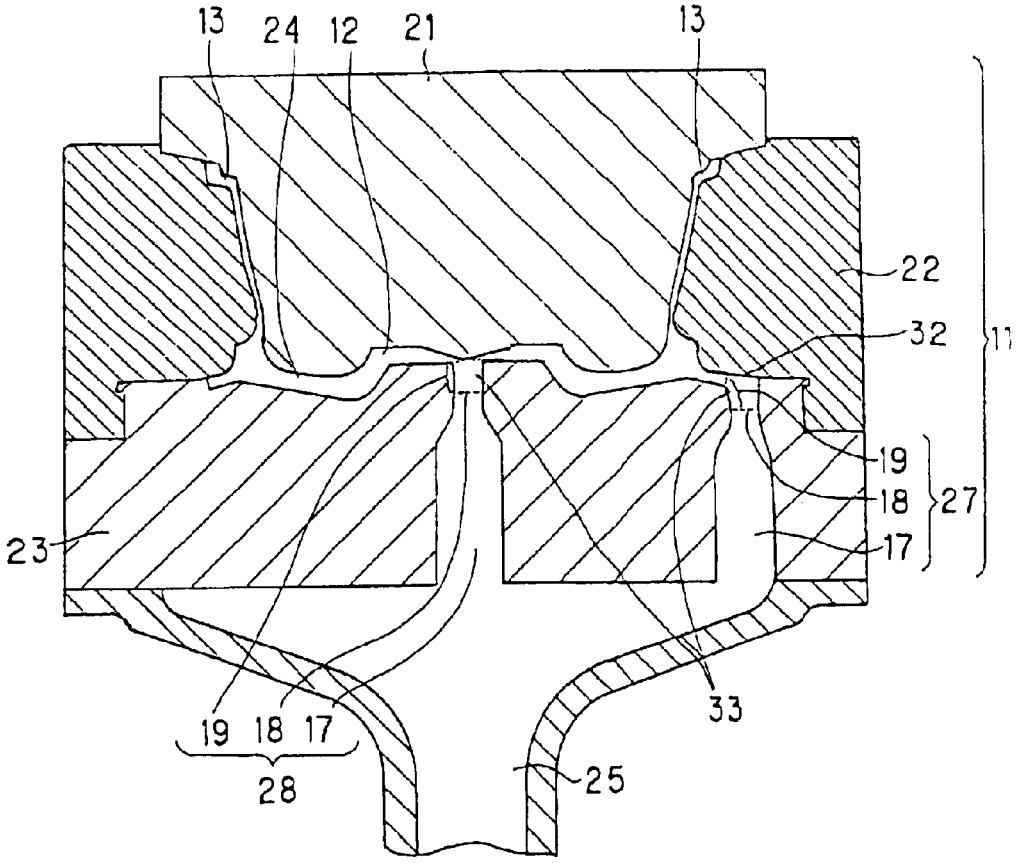
FIG. 2 is an explanatory view showing one embodiment of the mold for casting according to the present invention, and is a sectional view of a wheel which is a cast member as a mold target.
Figure 3:
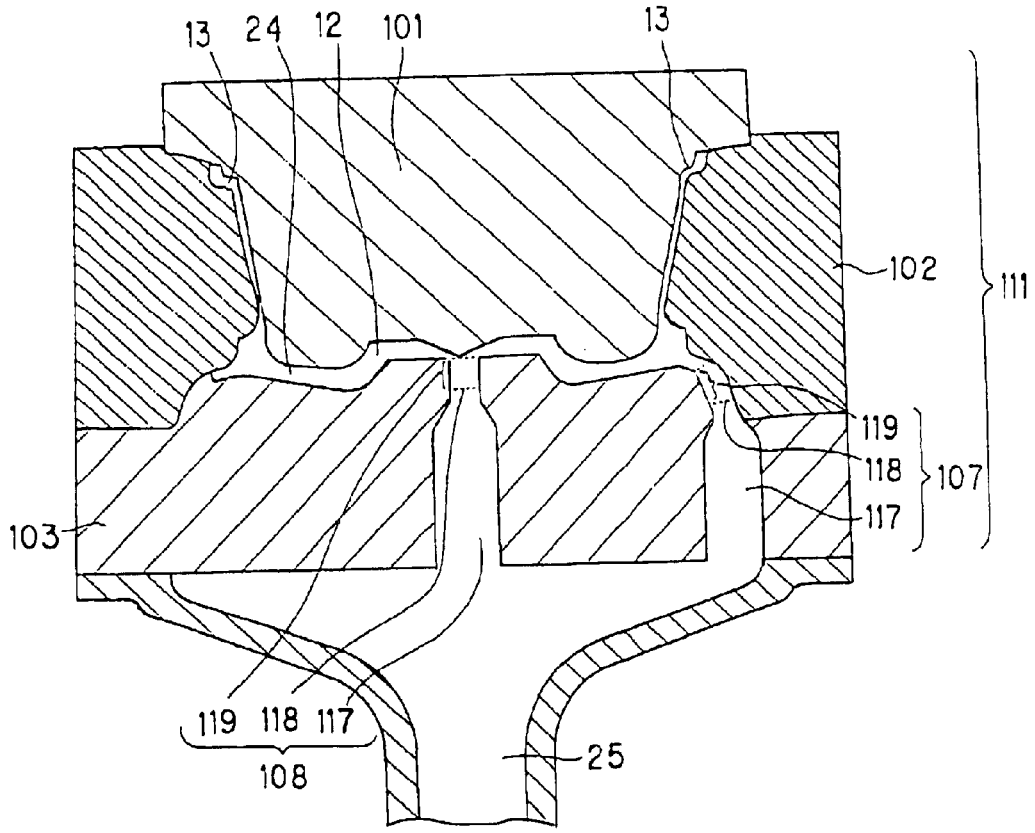
FIG. 3 is a diagram showing one example of a conventional mold for casting, and is a sectional view of the wheel which is the cast member as the mold target.

A mold for casting 11 shown in FIG. 2 includes a plurality of gate systems for use in a low-pressure casting method. The mold for casting 11 is connected to a stoke 25 constituting a channel in which the molten metal is pushed upwards into the mold from a stock furnace (not shown). The mold for casting 11 includes an upper mold 21, side molds 22, and a lower mold 23 forming a cavity 24 which is a molding space, and is used in casting a wheel 41 including thick-wall spokes 44 and thin-wall rims (inner rim 42 and outer rim 43). The cavity 24 includes a cavity 12 for molding the thick-wall spokes 44, and a cavity 13 for molding the thin-wall rims.

A surface forming the cavity 12 is defined by the upper mold 21 and lower mold 23, and a surface forming the cavity 13 is defined by the upper mold 21 and side molds 22. Moreover, although not shown, the side molds 22 are disposed to surround the cavity 13, and are split into two in a vertical (longitudinal) direction.

The mold for casting 11 includes gate systems 27, 28 each including a gate 18 for supplying the molten metal to the cavity 24, a passageway 17 which is a molten metal channel to the gate 18 from the stoke 25, and a weir 19 extending between the gate 18 and cavity 24. The gate system 27 is connected to the cavity 13 for molding the rim, and the characteristics of the present invention are embodied here. The other gate system 28 is connected to the cavity 12 for molding the spoke in the cavity 24.

Figure 4:
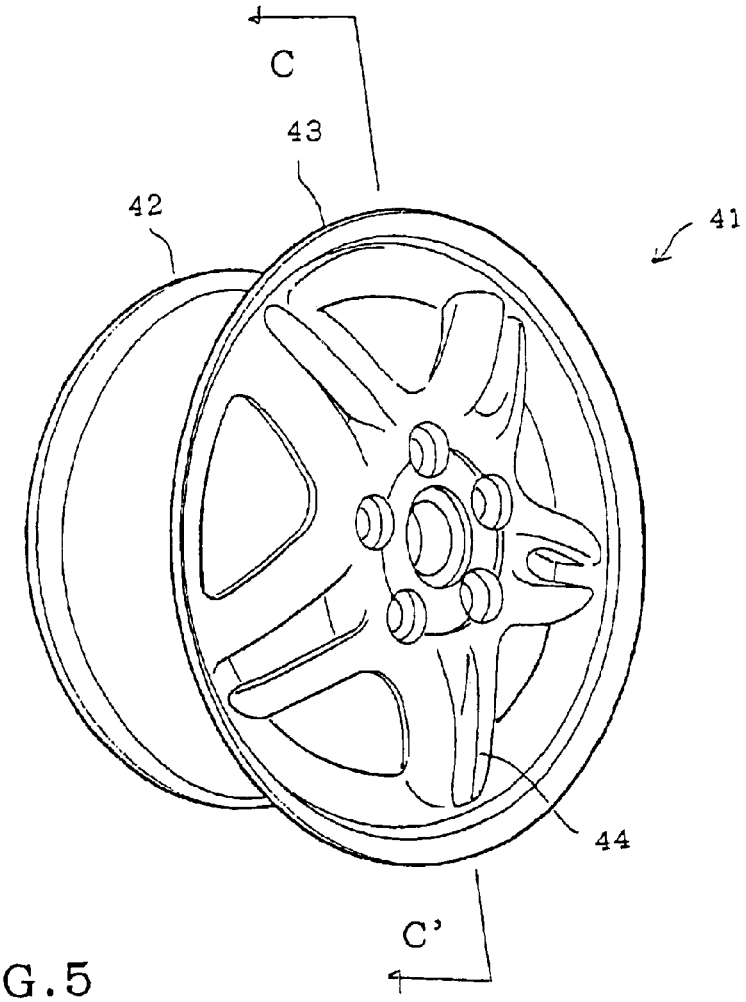
FIG. 4 is a diagram showing one example of the cast member molded by the mold for casting, and is a perspective view of the wheel.
Figure 5:
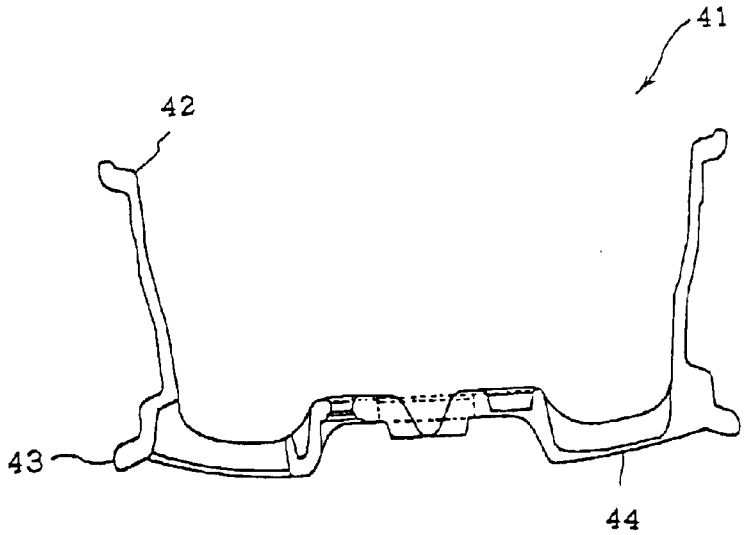
FIG. 5 is a C–C' sectional view of the wheel shown in FIG. 4.

For the mold for casting 11 for molding a wheel 41 for vehicles shown in FIGS. 4, 5, although not show, a plurality of gate systems 27 is arranged at equal intervals in a circumference of the cylindrical cavity 13 for molding the rim. The same number of, that is, five gate systems 27 as that of spokes 44 are preferably disposed so that the gate 18 is disposed in a position corresponding to a portion for connecting the spokes 44 to the outer rims 43. When the molten metal is charged, a moving distance of the molten metal becomes shorter than that of a center gate type mold. The charging is facilitated, molten metal drawing defect hardly occurs, and only a short time is required for charging the molten metal. A time required for all casting steps is reduced, and the throughput of cast product production can be enhanced.

As described above, in two gate systems 27, 28, the characteristics of the present invention are embodied in the gate system 27. The gate system 27 will be described hereinafter.

In the gate system 27, the passageway 17 is formed in the lower mold 23, and the weir 19 connected to the gate is formed by a concave portion 33 of the lower mold 23 and a flat portion 32 of the side mold 22. The concave portion 33 is opened upwards in an open mold state. However, when the mold is closed, the upper part of the concave portion is closed by the flat portion 32 of the side mold 22 having no concave/convex portion to form the weir 19.

The flat portion 32 of the side mold 22 serves as a lid member for closing the upper part of the lower mold 23, and constitutes a part of the weir 19 for connecting the gate 18 to the cavity 24 (cavity 13). Moreover, the flat portion is inclined slightly downwards toward the outside of the mold from the cavity 24 (cavity 13). The flat portion 32 of the side mold 22 is continuously formed so as to surround the outer periphery of the cavity 13, because a plurality of gate systems 27 are arranged so as to be mutually connected at equal intervals in the circumference of the cylindrical cavity 13 for molding the rim.

In the above-described constitution, since the weir 19 is not carved in the side mold 22 on the basis of the PL face between the lower mold 23 and side mold 22. Therefore, the molten metal having overflowed from the cavity 13 to coagulate (pushed molten metal portion) does not penetrate into the side mold 22 to be demolded. The lower mold 23 and the side mold 22 hardly friction each other, and this promises smooth mold opening.

Next, a split insert to be disposed in the surface constituting the weir will be described.

Figure 6:
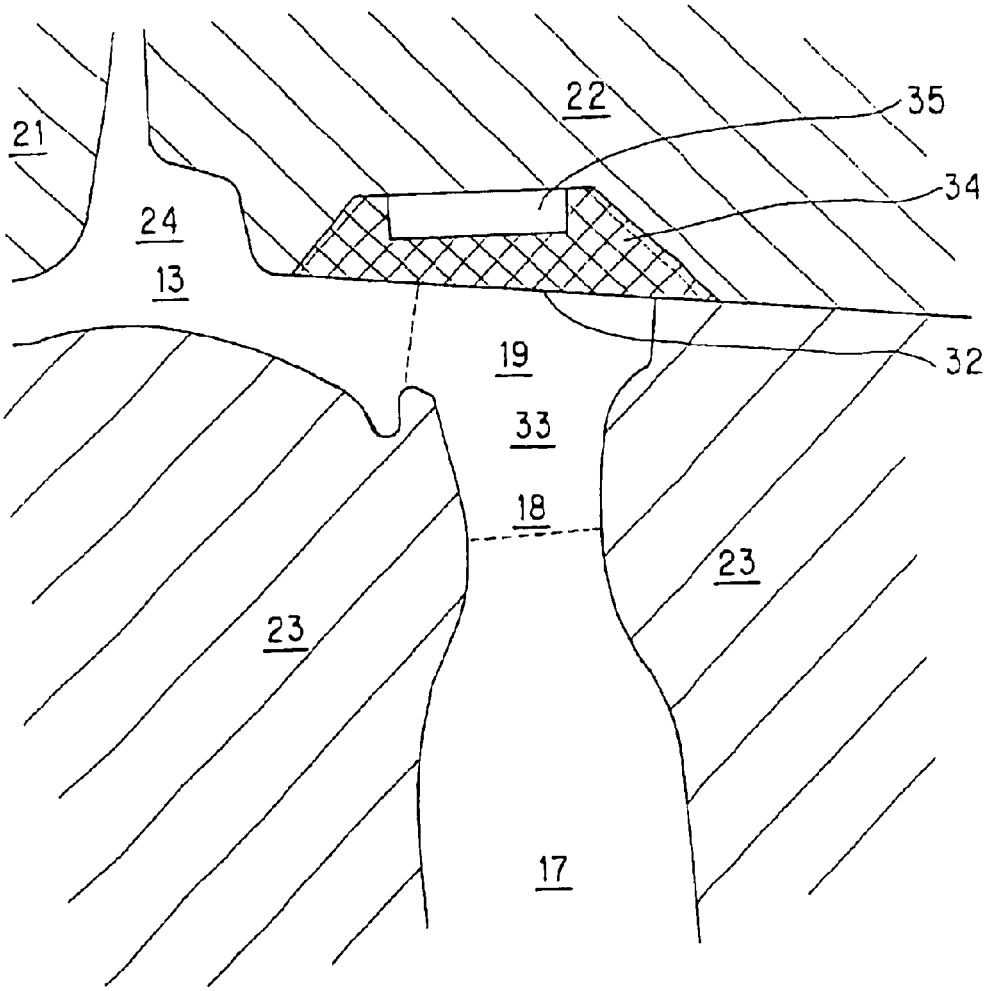
FIG. 6 is an explanatory view showing another embodiment of the mold for casting according to the present invention, and is an enlarged sectional view of a weir portion in a case in which the cast member as the mold target is the wheel.

FIG. 6 is an enlarged diagram of a section in the vicinity of the weir of the same mold as the mold for casting 11 shown in FIG. 2, except that the split insert is disposed. The weir 19 for connecting the cavity 13 to the gate 18 is formed of the concave portion 33 of the lower mold 23 and the slightly inclined flat portion 32 of the side mold 22. As shown, a split insert 34 is incorporated in the side mold 22 via a gap 35. Moreover, the flat portion 32 is constituted of the split insert 34. It is to be noted that the gap 35 may be used as a space (filled with air) as such, and may also preferably be filled with an insulating material.

The weir 19 is a portion for injecting the molten metal into the cavity 24, and has a reduced sectional area. However, since the split insert 34 is disposed, the heat is not easily released from the molten metal moving in the weir 19, solidification in the weir 19 can be delayed, and therefore a molten metal replenishing property into the cavity 24 at the time of coagulation/contraction is enhanced. As a result, casting defects such as shrinkage cavity hardly occurs, and deterioration of mechanical properties of the wheel can be prevented.

As described above, in the mold for casting according to the present invention, since the concave portion formed in the lower mold and the flat portion including no concave/convex portion in the side mold constitute the weir, it is easy to open the mold, and it is possible to form the desired number of gates in the desired positions.

What is claimed is:

1. A mold for casting comprising:

a lower mold including at least one gate;

an upper mold which is matched with the lower mold to form a cavity; and a side mold which is matched with the lower and upper molds to form the cavity and which is split into at least two side mold halves, characterized in that a weir for connecting the cavity to the gate includes an upper surface constituted of a flat portion of the side mold, and surfaces other than the upper surface, constituted of a concave portion of the lower mold, and is disposed so as to keep a parting line between at least two split side mold halves away from the weir.

2. The mold for casting according to claim 1, wherein the flat portion of the side mold is inclined slightly downwards to the outside of the mold from a center of the cavity.

3. The mold for casting according to claim 1, wherein the flat portion of the side mold is formed of a split insert.

* * * * *